US005577690A

United States Patent [19]

Haddox

[11] Patent Number: 5,577,690

[45] Date of Patent: Nov. 26, 1996

[54] MICROWAVE MEASUREMENT OF TRAIN WHEEL WEAR

[75] Inventor: Mark L. Haddox, Ann Arbor, Mich.

[73] Assignee: Jodon Engineering Associates, Inc., Ann Arbor, Mich.

[21] Appl. No.: 306,640

[22] Filed: Sep. 15, 1994

[51] Int. Cl.[6] ..... B61L 23/00

[52] U.S. Cl. ..... 246/169 R; 73/146; 33/1 Q

[58] Field of Search ..... 246/169 R, 169 D; 73/146; 33/1 Q, 203, 203.11, 203.19

[56] References Cited

U.S. PATENT DOCUMENTS

| | | | |
|---|---|---|---|
| 2,605,392 | 7/1952 | Gieskieng | 246/169 R |
| 3,648,164 | 3/1972 | Searle et al. | 73/146 |
| 4,696,446 | 9/1987 | Mochizuki et al. | 246/169 R |
| 5,421,197 | 6/1995 | Ohms | 73/146 |

*Primary Examiner*—S. Joseph Morano
*Attorney, Agent, or Firm*—Barnes, Kisselle, Raisch, Choate, Whittemore & Hulbert

[57] ABSTRACT

A method and apparatus for measuring circumferential characteristics of train wheels for potential indication of train wheel wear that includes at least one microwave transceiver disposed adjacent to a section of train track and oriented to transmit microwave energy toward and receive microwave energy reflected from a radially oriented surface of a train wheel that traverses the track section. Wheels are rolled along the track section in sequence while the transceiver is energized so as to transmit energy toward the wheel and develop a varying interference pattern of peaks (alternating minima and maxima) caused by reflection from the radially oriented surface of the wheel. The transceiver provides an electrical signal that varies as a function of such interference pattern, and one or more desired radial characteristics of the wheel are determined as a function of such signal.

28 Claims, 4 Drawing Sheets

MICROWAVE MEASUREMENT OF TRAIN WHEEL WEAR

The present invention is directed to measurement of radial characteristics of test objects such as train wheels, and more particularly to a method and apparatus for measuring train wheel wear as a function of radial dimensional characteristics of the wheel rim and/or wheel flange.

BACKGROUND AND OBJECTS OF THE INVENTION

There are a number of circumferential characteristics or parameters of train wheels that are important for maintenance and safety purposes. These characteristics include radius and diameter of the wheel rim on which the car or locomotive rides on the track, radius and diameter of the wheel flange that extends from the rim surface, out-of-roundness of the rim and flange, eccentricity of the rim surface with respect to the flange, flat spots in the rim or flange, and spalls and tread build-up on the rim surface.

Dimensional characteristics of a train wheel rim and flange are currently measured using a device called a standard steel wheel finger gauge. This measurement technique achieves somewhat less than desired accuracy, and the time and tedium involved do not encourage measurement at the desired frequency. It has been proposed to provide an instrumented track or rail section having accelerometers for detecting flat spots in train wheels as an engine or car is driven over the track section. Although this technique has been helpful in identifying flat spots in the wheel rim, there remains a need for an automatic and non-contact method of measuring geometric characteristics such as radius, out-of-roundness and eccentricity.

It is therefore a general object of the present invention to provide a technique for measuring one or more circumferential characteristics of a test object such as a train wheel that does not require physical contact with the test object, and that may be implemented electronically for enhanced accuracy and automation. Another and more specific object of the present invention is to provide a method and apparatus for measuring one or more circumferential characteristics of train wheels, such as wheel rim and/or flange radius, that may be implemented automatically while the train wheels carry train cars over an instrumented section of track. A further object of the present invention is to provide a method and apparatus of the described character that employ microwave technology for measuring train wheel rim and/or flange radius, and other circumferential characteristics associated with rim and flange radius such as diameter, wear, flat spots and eccentricity, automatically and at high speed as the train wheels pass in succession over an instrumented section of track.

SUMMARY OF THE INVENTION

A method of measuring radial characteristics of a test object in accordance with the present invention contemplates provision of a transceiver, preferably a microwave transceiver, oriented to transmit energy toward and receive energy reflected from a radially oriented surface of the test object. Relative motion between the test object and the transceiver while the transceiver is energized develops at the transceiver an electrical signal that varies as a function of interferences caused by reflections from the surface of the test object. Radial characteristics of the text object are determined as a function of such interference test. The interference pattern represented by the transceiver output signal comprises a sinusoidal pattern of peaks (alternating maxima and minima), and radial characteristics of the test object are determined as a function of separation between the peaks in units of distance traveled during relative motion between the transceiver and the test object.

A method and apparatus for measuring circumferential characteristics of train wheels for potential indication of train wheel wear in accordance with the preferred implementation of the invention include at least one microwave transceiver disposed adjacent to a section of train track. The transceiver is oriented to transmit microwave energy toward and receive microwave energy reflected from a radially oriented surface of each train wheel that traverses the track section. Wheels are rolled along the track section in sequence while the transceiver is energized so as to transmit energy toward each wheel in turn, and to develop a varying interference pattern of peaks (alternating minima and maxima) caused by reflection from the radially oriented surface of each wheel. The transceiver provides an electrical signal that varies as a function of such interference pattern, and one or more desired radial characteristics of the wheel are determined as a function of such signal.

In the preferred embodiment of the invention, train wheel radius is determined as a function of separation between peaks (either minima or maxima) in units of distance traveled by the wheel along the track section adjacent to the transceiver. This is accomplished in the preferred embodiment of the invention by sampling the transceiver output signal at equal time increments while causing each train wheel to roll along the instrumented track section at constant velocity. Alternatively, the transceiver output signal may be sampled at predetermined increments of distance traveled along the track section, or the transceiver output signal may be sampled at predetermined time increments while actual velocity of the wheel along the track is measured. In any event, radius of the test surface, which may be the load bearing surface of the wheel rim or the outer edge of the wheel flange, is determined in the preferred embodiment of the invention as a function of separation between adjacent or non-adjacent peaks of the interference signal in units of distance.

A plurality of transceivers are spaced from each other along the track section in the preferred embodiment of the invention, and radial characteristics of each train wheel are determined independently based upon the output of each transceiver. The radial characteristics so determined may be averaged, or may be compared with each other to detect variations potentially indicative of wheel wear. For measurement of wheel flange radius, the transceiver(s) in the preferred embodiment of the invention is disposed laterally adjacent to the track section, and oriented to direct microwave energy upwardly onto the outer diameter of the wheel flange as a wheel rolls over the track section. For measurement of rim radius in the preferred embodiments of the invention, the transceiver is disposed to transmit microwave energy upwardly through the rail surface onto the load-bearing surface of a wheel rim as the wheel rolls over the track surface. The transceiver output signal is sampled by a digital processor. One or more proximity sensors are disposed adjacent to the track section for both initiating a data sampling sequence as a wheel passes over the transceiver(s) and measuring actual wheel velocity where needed for data translation purposes.

BRIEF DESCRIPTION OF THE DRAWINGS

The invention, together with additional objects, features and advantages thereof will be best understood from the following description, the appended claims and the accompanying drawings in which:

DETAILED DESCRIPTION OF PREFERRED EMBODIMENTS

Figure 1:
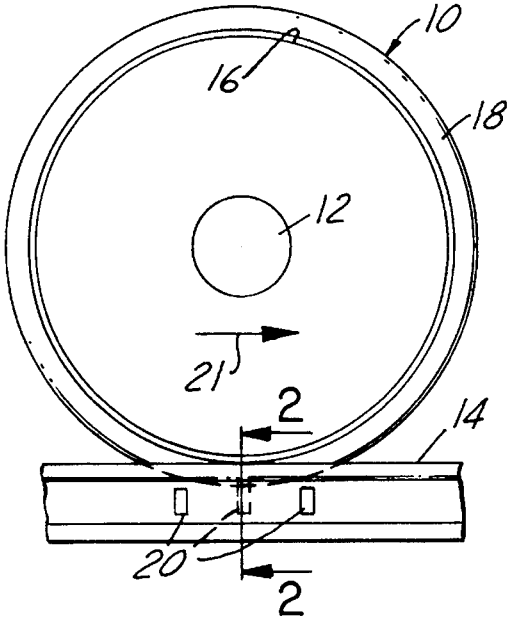
FIG. 1 is a side elevational view of a train wheel on a track section having wheel measurement transceivers in accordance with one presently preferred embodiment of the invention.

FIG. 1 illustrates a train wheel 10 mounted on an axle 12 for supporting a train car or locomotive (not shown) as wheel 10 rolls along a section of track rail 14. Wheel 10 has the usual axially extending and radially facing rim surface 16 for supporting and bearing the load of the wheel and car on the upper surface of rail 14, and a flange 18 radially extending from rim surface 16 at one side edge of wheel 10 for retaining the wheel on the rail. Three microwave transceivers 20 are illustrated in FIG. 1 spaced from each other lengthwise on track section 14 for measuring radial characteristics of wheel 10 as wheel 10 is rolled along track 14 in direction 21 past the transducers.

Figure 2:
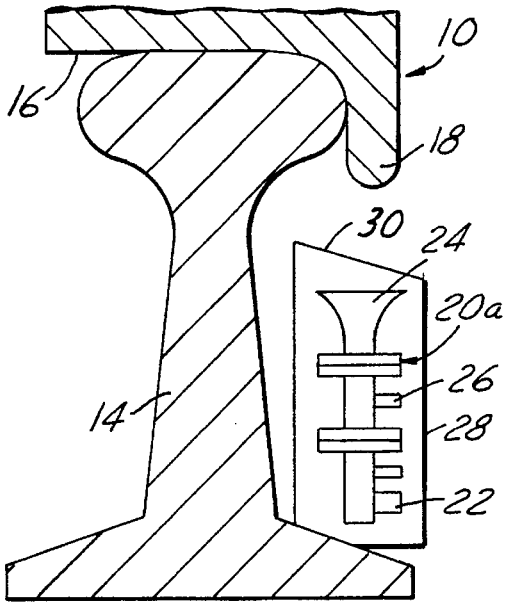
FIG. 2 is a fragmentary sectional view taken substantially along the line 2—2 in FIG. 1 with transceiver for measuring wheel flange radius.

FIG. 2 illustrates one embodiment 20*a* of transceivers 20 for measuring the outer radius of rim flange 18. Transceiver 20*a* includes a Gunn diode 22 for directing microwave energy through a horn 24 upwardly toward the radially facing surface of flange 18, and a detector 26 for receiving microwave energy reflected downwardly from flange 18 back to the transceiver. Transceiver 20*a* is mounted within an enclosure 28 for protection against the weather, and has an upper surface 30 that is sloped to prevent accumulation of water or debris. Enclosure 28 is mounted to the side of track section 14 beneath the side edge of the upper rail section for alignment with flange 18 as described.

Figure 3:
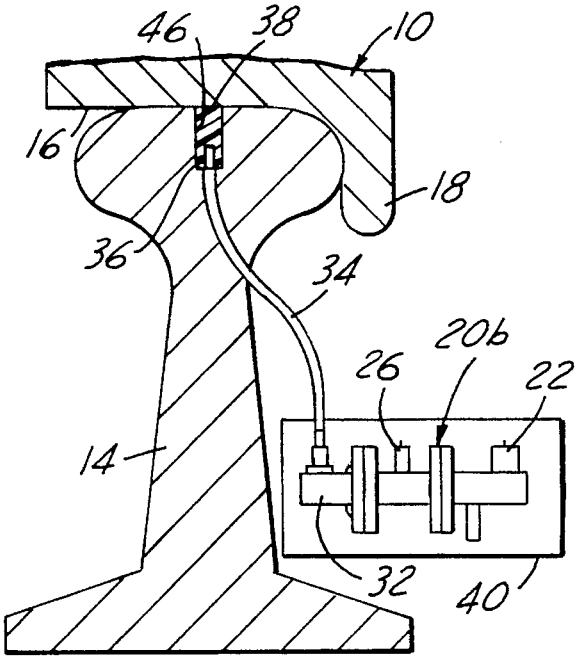
FIG. 3 is a sectional view similar to that of FIG. 2 but showing a transceiver for measuring wheel rim radius.
Figure 4:
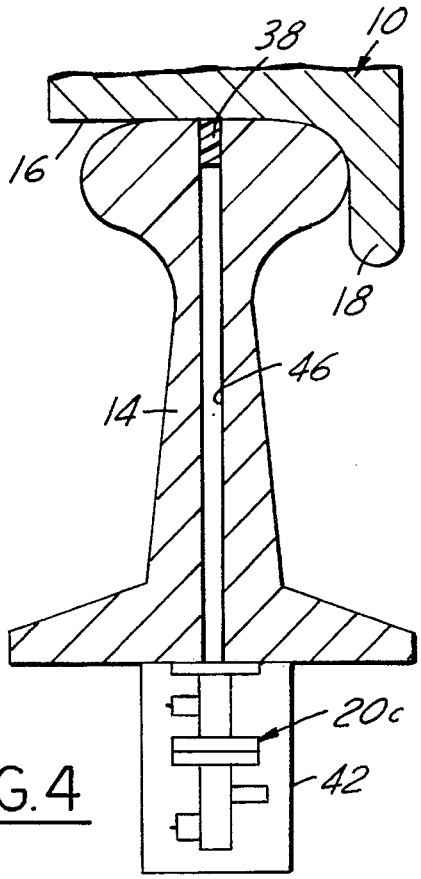
FIG. 4 is a sectional view that illustrates a modification to the embodiment of FIG. 3.

FIG. 3 illustrates another embodiment 20*b* of transceiver 20, again including a Gunn diode 22 for transmitting microwave energy to a waveguide-to-coax adapter 32 and a coax cable 34. Coax cable 34 terminates in an antenna 36 (about a quarter-wavelength) that radiates microwave energy into a waveguide cavity 46 at the upper edge of rail section 14. The microwave energy then travels through dielectric material 38 within cavity 46 onto the radially facing rim surface 16 of a train wheel 10 rolling over track section 14. Reflected energy travels back through dielectric material 38 within cavity 46, coax 34 and adapter 32 to detector 26. Once again, transceiver 20*b* is surrounded within a protective enclosure 40 affixed to the side of rail 14. In the modified embodiment of FIG. 4, transceiver 20*c* is mounted within an enclosure 42 beneath the foot of rail 14. Microwave energy is transmitted and reflected through a rectangular passage 46 within track 14, which effectively forms a rectangular waveguide, and through a protective dielectric filling or seal 38 onto rim surface 16 of wheel 10. In both the embodiments of FIGS. 3 and 4, the associated transceiver 20*b*, 20*c* thus directs microwave energy upwardly onto rim surface 16, and receives energy reflected from rim surface 16 as wheel 10 passes thereover. Also, in both embodiments, the waveguide opening may be flared outward slightly at the top of the track in order to emulate a horn antenna more closely, and thereby improve the impedance match to the region above the track. By way of example only, enclosures 28,40,42 may be of fiberglass/polyester construction manufactured by Hoffman Engineering Co.; transceiver 20*a*,20*b*,20*c* may comprise a model MA86652 horn antenna or a model MA86859 (24.15 Ghz) transceiver manufactured by M/A-COM Inc.

Figure 5:
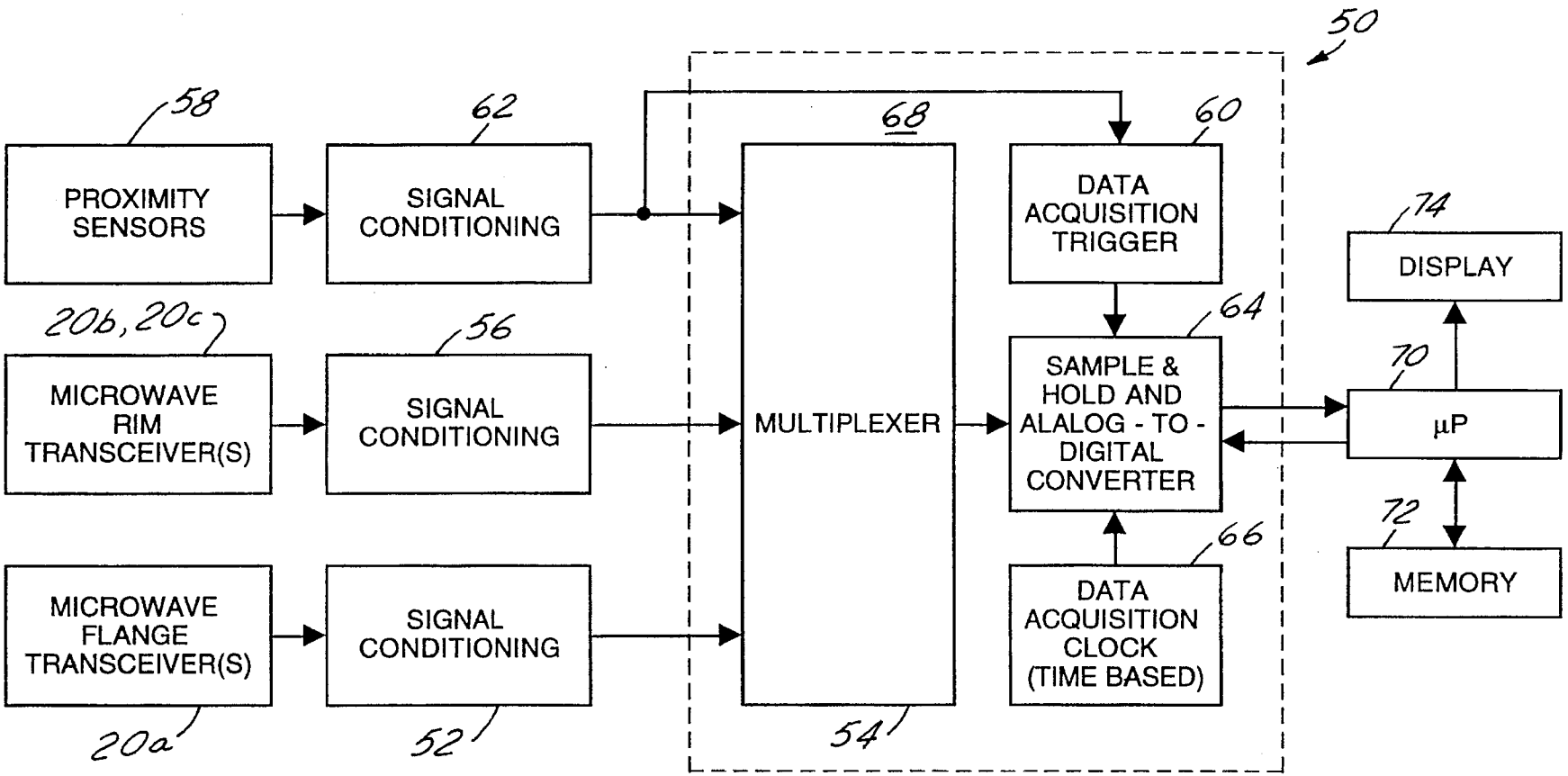
FIG. 5 is a functional block diagram of control electronics in accordance with a presently preferred embodiment of the invention.

FIG. 5 illustrates a preferred embodiment of control electronics 50 in accordance with the present invention. Microwave flange transceiver(s) 20*a* (FIG. 2) is connected to one input of a multiplexer 54 through associated signal conditioning circuitry 52. Similarly, microwave rim transceiver(s) 20*b* or 20*c* is connected to a second input of multiplexer 54 through associated signal conditioning circuitry 56. One or more proximity sensors 58 are positioned adjacent to track 14 and responsive to passage of a wheel 10 over measurement transceivers 20 (FIG. 1) for both initiating a data acquisition cycle through a data acquisition trigger 60 (FIG. 5), and for providing wheel speed and direction information to a third input of multiplexer 54 through a signal conditioning circuit 62. The output of multiplexer 54 is connected to a sample-and-hold and analog-to-digital conversion circuit 64, which receives a control input from data acquisition trigger 60 and a clock input from a time-based data acquisition clock 66. Multiplexer 54, data acquisition trigger 60, converter 64 and clock 66 thus form a data acquisition sub-system 68, which has an output connected to a control microprocessor 70, and which in turn is controlled by microprocessor 70. Microprocessor 70 is connected by a suitable bus to a supplemented digital memory 72 for storing blocks of wheel test data for later analysis, and to a suitable display mechanism 74 such as a screen or printer. By way of example, data acquisition subsystem 68 may comprise a DT2839 analog and digital I/O board manufactured by Data Translation, Inc., and microprocessor 70 may comprise any suitable personal computer.

In operation, data acquisition sub-system 68 is activated by proximity sensor(s) 58 to initiate a data sampling and data conversion operation via multiplexer 54 and one or all of the transceivers 20*a*,20*b* and 20*c*. The incoming data from the transceiver(s) is suitably conditioned, sampled at fixed time intervals under control of clock 66, converted to digital format, and fed to microprocessor 70 for storage in memory 72. Where velocity information is desired, signal information from proximity sensors 58 is also suitably conditioned at 62, sampled and converted to digital format at 64, and stored in memory 72 by microprocessor 70.

Figure 6A:
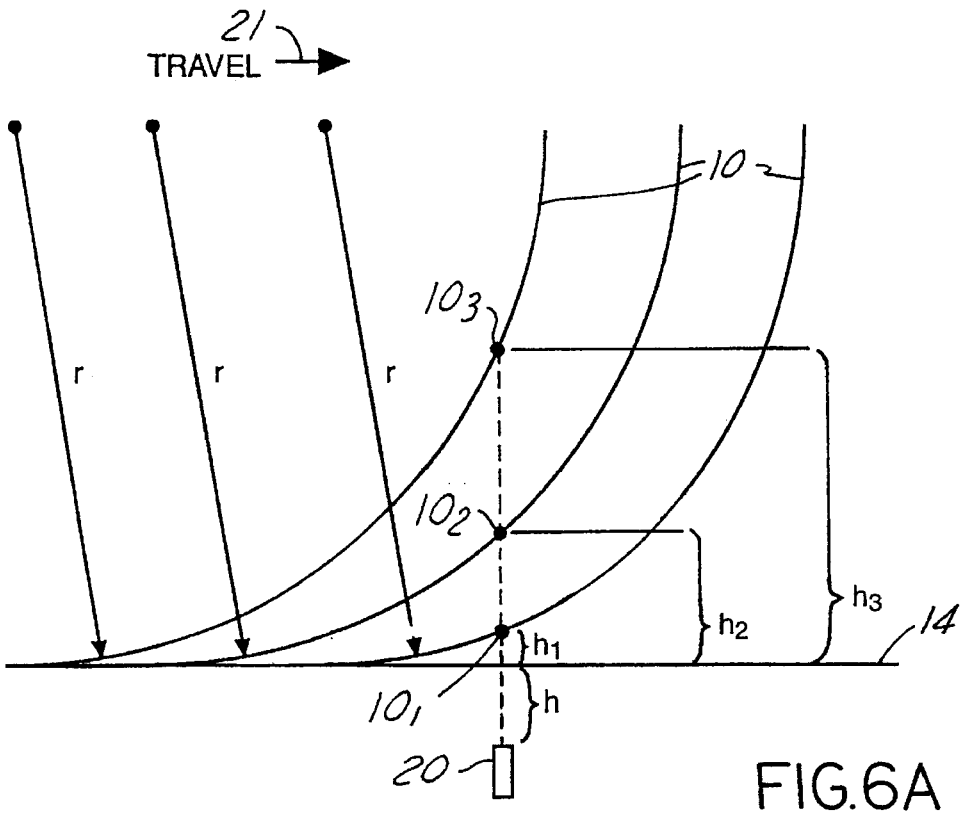
FIGS. 6A and 6B are graphic illustrations that facilitate explanation of operation of the invention.
Figure 6B:
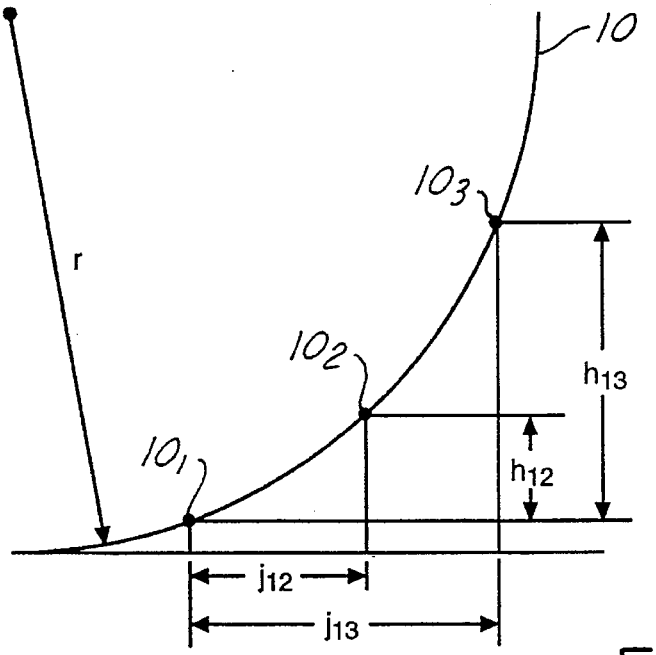
Figure 7:
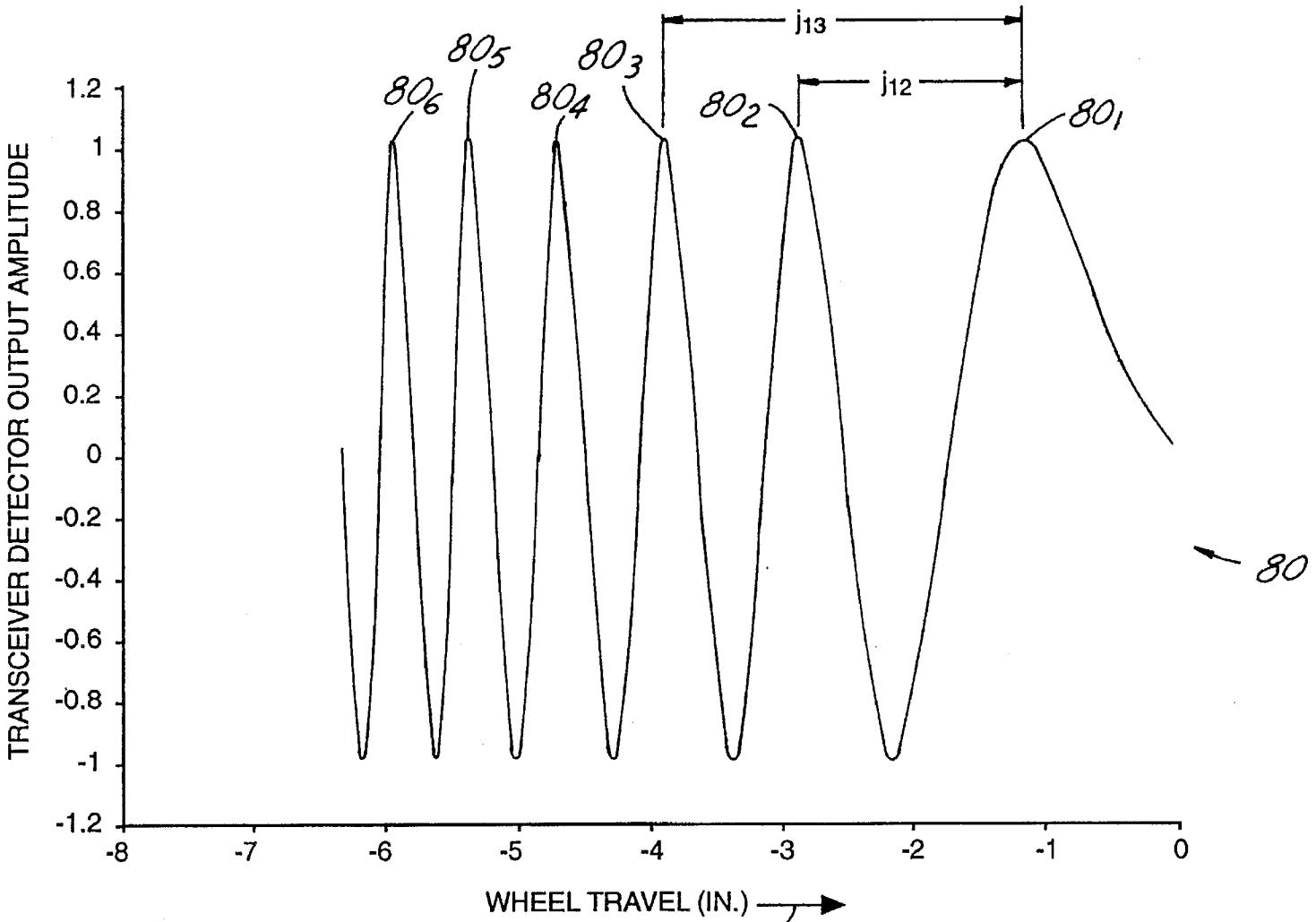
FIG. 7 is a graphic illustration of transceiver detector output amplitude versus wheel position, and which is also useful in describing operation of the invention.

Each transceiver 20*a*,20*b*,20*c* emits a continuous microwave signal toward the wheel flange or rim as it passes over the transceiver location on track section 14. As the wheel passes over each transceiver, an interference pattern caused by reflections from the radially oriented surface of the flange or rim causes the transceiver detector output to form a sinusoidal pattern of varying frequency, as illustrated in FIG. 7. That is, as the wheel approaches each transceiver, the output of the transceiver detector assumes a pattern 80 as illustrated in FIG. 7 in the form of a series of peaks consisting of alternating maxima and minima. The interference effect that gives rise to these signal peaks can be visualized in FIG. 6A. With wheel 10 traveling in direction 21 from left to right, the total distance ($h+h_3$) between transceiver 20 and the opposing point $\mathbf{10}_3$ on the wheel is such that a first interference peak $\mathbf{80}_3$ (FIG. 7) is created. As wheel 10 continues to move to the right, the distance between transceiver 20 and the opposing point $\mathbf{10}_2$ has decreased to a total distance ($h+h_2$), again giving rise to a interference peak $\mathbf{80}_2$ (FIG. 7). Continued motion of wheel 10 to the right in FIG. 6 brings another point 101 into opposition with transceiver 20 at a distance (h+h1) creating a third interference pattern $\mathbf{80}_1$ (FIG. 7). Three interference peaks are required for measuring wheel radius r in accordance with the technique to be described in connection with FIG. 6B, and for this reason three specific points $\mathbf{10}_1$, $\mathbf{10}_2$ and $\mathbf{10}_3$ are illustrated in FIG. 6. It will be appreciated, however, that a multiplicity of additional interference peaks $\mathbf{80}_4$–$\mathbf{80}_6$ (FIG. 7) are also created at wheel positions prior to those shown in FIG. 6. Likewise, as the wheel makes contact with rail 14 immediately above transceiver 20, and then continues motion away from transceiver 20, a second series of interference peaks will be generated nominally as the mirror image of pattern 80 illustrated in FIG. 7. Signals 80 generated by all of the transceivers 20 are sampled and stored in memory 72 as wheel 14 passes over the transceiver.

It will be noted in FIG. 7 that transceiver amplitude data is represented in units of distance of wheel travel along track 14 over the transceiver. In order to perform the calculations to be described in connection with FIG. 6B, it is necessary that the interference information be either stored or accessible in units of distance of wheel travel, as distinguished from units of time. This is accomplished in accordance with the preferred embodiment of the invention by driving the train over track section 14 at constant velocity, so that each sample time increment automatically represents a corresponding fixed increment of wheel travel. For example, if the train speed is 60 miles per hour and the sampling period of clock 66 (FIG. 5) is twenty-five microseconds, each sample increment automatically represents a distance of 0.0264 inches of wheel travel. Alternatively, if train speed is unknown or variable, proximity sensors 58 at predetermined fixed spacing may be employed in conjunction with clock 66 to determine speed of wheel travel over the measurement transceivers, and the fixed sampling intervals of clock 66 may be related to distance of wheel travel by multiplying the sampling intervals by measured wheel speed. As a third alternative, the train may be instrumented to provide a sampling signal at fixed increments of distance, thereby replacing time-based clock 66 with data sampling in the spatial domain. In any event, the resulting data stored in memory 72 is exemplified by FIG. 7, in which normalized transceiver detector output amplitude (simulated) is illustrated as varying as a function of wheel travel distance.

In FIG. 6B, the data points of FIG. 6A have been transformed to reflect a fixed wheel position 10, and both horizontal and vertical separation between the wheel rim data points. It can be shown that radius r in FIG. 6A is given by the equation:

$$r=\sqrt{\left[\frac{h_{12}^2+\frac{j_{12}\cdot[h_{12}\cdot(h_{13}^2+j_{13}^2)-h_{13}\cdot(h_{12}^2+j_{12}^2)]}{h_{13}\cdot j_{12}-h_{12}\cdot j_{13}}+j_{12}^2}{2\cdot h_{12}}\right]^2+\left[\frac{h_{12}\cdot(h_{13}^2+j_{13}^2)-h_{13}\cdot(h_{12}^2+j_{12}^2)}{2\cdot(h_{13}\cdot j_{12}-h_{12}\cdot j_{13})}\right]^2}$$

where $j_{12}$ is separation in units of wheel travel between peaks $\mathbf{80}_1$ and $\mathbf{80}_2$ in FIG. 7, $j_{13}$ is separation in units of wheel travel between peaks $\mathbf{80}_1$ and $\mathbf{80}_3$ in FIG. 7, and $h_{12}$ and $h_{13}$ are related to the specific peaks selected for measurement purposes, peaks $\mathbf{80}_1$, $\mathbf{80}_2$ and $\mathbf{80}_3$ in this particular example. Specifically, both $h_{12}$ and $h_{13}$ are equal to $n\lambda/2$, where $\lambda$ is the wavelength of the microwave signal and n is the number plus 1 of peaks between the peaks selected for measurement purposes. Thus, $h_{12}$ in this particular example is equal to $\lambda/2$, and $h_{13}$ is equal to $\lambda$. At an exemplary transceiver frequency of 24.15 GHz, $h_{12}$ in this example would be equal to 0.244535 inches, and $h_{13}$ would be equal to 0.489069 inches. In the particular example illustrated in FIG. 7, $j_{12}$ is equal to 1.6600 inches, and $j_{13}$ is equal to 2.6727 inches. Thus, in the above equation, all of the h and j variables are known, and radius r may be calculated. In the example, radius r is equal to 15.0 inches. It will be appreciated that the equation for radius r is sensitive to changes in the h and j variables, and that values for these variables should therefore be rendered and controlled with a high degree of accuracy.

The foregoing example discussed in connection with FIGS. 6A, 6B and 7 applies to both wheel rim and wheel flange radius measurements. When employing transceivers 20 as illustrated in FIG. 1, a total of six measurements can be made, one as the wheel approaches and one as the wheel leaves each of the three transducers. It will also be noted that multiple measurements can be made from a single set of data illustrated graphically at 80 in FIG. 7 employing different peaks—i.e., peaks other than $\mathbf{80}_1$, $\mathbf{80}_2$ and $\mathbf{80}_3$. It will also be appreciated that the minima peaks may also be employed. Thus, any number of radius measurements may be obtained from a single passage of wheel 10 over one or more transceivers, and may be averaged or compared to each other for indicating a measured radius variance potentially indicative of a flat spot, another sign of wheel wear or defective data from the transceiver. Averaging a number of radius measurements can significantly reduce the effect of system noise and imperfect transceiver data. It will also be noted that the amplitude of the signal 80 in FIG. 7 at either the maximum or minimum peak is of no consequence to the radius measurement. However, amplitude information can be employed for identifying characteristics that affect reflectivity, such as spalls or tread formation on the wheel rim surface. Radius and diameter measurements of the wheel rim and flange can be correlated to determine eccentricity between the rim and flange centers, and to locate excessive flange wear that could lead to derailment in use.

There is thus provided in accordance with the disclosed embodiments of the invention a fully automatic apparatus for non-contact measurement of train wheel rim and flange radial characteristics employing microwave technology. An entire train may be driven over a section of track instrumented on both sides in accordance with the present invention, and wheel measurement data may be rapidly collected for later analysis to identify wheels having excessive wear or undesirable surface characteristics at the rim and/or flange. The rate of data acquisition depends upon factors such as maximum expected train speed and the desired degree of measurement accuracy. For a maximum train speed of sixty miles per hour, the data acquisition rate may be on the order of thirty to one hundred thousand samples per second per data channel. Software data enhancement techniques, such as the use of interpolation for better resolution of maxima or minima, can be employed to improve measurement accuracy. Frequency stability of the transceiver(s) can be improved through the use of thermostatically controlled heating elements to reduce temperature variation. The instrumented rail section may be part of a long section of track with a slight curvature to reduce side-to-side oscillatory motion during measurement cycles.

I claim:

1. A method of measuring a circumferential characteristic of train wheels potentially indicative of train wheel wear comprising the steps of:

(a) providing at least one transceiver adjacent to track section oriented to transmit energy toward and receive energy reflected from a radially oriented surface of a wheel that traverses said track section, (b) causing a train wheel to traverse said track section so as to develop at said transceiver a signal that exhibits an interference pattern of signal peaks caused by reflections from the radially oriented wheel surface, and (c) determining a circumferential characteristic of said radially oriented wheel surface as a function of separation between said signal peaks of said interference pattern in units of distance traveled by the wheel along said track section adjacent to said transceiver.

2. The method set forth in claim 1 wherein said step (c) comprises the step of determining radius of the wheel as a function of said interference pattern.

3. A method of measuring a circumferential characteristic of train wheels potentially indicative of train wheel wear comprising the steps of:

(a) locating at least one microwave transceiver adjacent to a track section, with said transceiver being oriented to transmit microwave energy toward and receive microwave energy reflected from a radially oriented surface of a wheel that transverse said track section, (b) causing a train wheel to roll along said track section, (c) during said step (b), energizing said transceiver to transmit microwave energy toward the wheel so as to develop at said transceiver a varying interference pattern of signal peaks caused by reflections from the radially oriented surface of the wheel, (d) providing at said transceiver an electrical signal that varies as a function of said interference pattern, and (e) determining a radial characteristic of the radially oriented wheel surface as a function of separation between signal peaks in said electrical signal in units of distance traveled by the wheel along said track section adjacent to said transceiver.

4. The method set forth in claim 3 wherein said step (e) comprises the step of sampling said electrical signal at increments of distance traveled by the wheel along the track section.

5. The method set forth in claim 3 wherein said step (b) comprises the step of causing the train wheel of transverse the track section at constant velocity, and wherein said step (e) comprises the step of sampling said electrical signal at equal time increments.

6. The method set forth in claim 3 wherein said step (c) comprises the step of: (c1) measuring velocity of the wheel as it traverse said track section in said step (b), (c2), sampling said electrical signal at equal time increments, and (c3) translating said signal sampled in said step (c2) into units of distance by multiplying velocity measured in said step (c1) by said time increments in said step (c2).

7. The method set forth in claim 3 wherein said step (e) comprises the step of determining said radial characteristic as a function of the equation:

$$r=\sqrt{\left[\frac{h_{ab}^2+\frac{j_{ab}\cdot[h_{ab}\cdot(h_{ac}^2+j_{ac}^2)-h_{ac}\cdot(h_{ab}^2+j_{ab}^2)]}{h_{ac}\cdot j_{ab}-h_{ab}\cdot j_{ac}}+j_{ab}^2}{2\cdot h_{ab}}\right]^2+\left[\frac{h_{ab}\cdot(h_{ac}^2+j_{ac}^2)-h_{ac}\cdot(h_{ab}^2+j_{ab}^2)}{2\cdot(h_{ac}\cdot j_{ab}-h_{ab}\cdot j_{ac})}\right]^2}$$

where r is said radial characteristic, $h_{ab}$ equals $n_{ab}\lambda/2$ where $\lambda$ is transmission wavelength of said transceiver and $n_{ab}$ is the number plus one of signal peaks between peaks a and b of said signal interference pattern, $h_{ac}$ is equal to $n_{ac}\lambda/2$ where $n_{ac}$ is the number plus one of the signal peaks between peaks a and c of said signal interference pattern, $j_{ab}$ is the interval in units of distance traveled by said wheel between signal peaks a and b, and $j_{ac}$ is the interval in units of distance traveled by said wheel between signal peaks a and c.

8. The method set forth in claim 3 wherein step (e) comprises the step of determining wheel rim radius.

9. The method set forth in claim 3 wherein said step (e) comprises the set of determining wheel flange radius.

10. The method set forth in claim 3 wherein said step (a) comprises the step of locating a plurality of said transceivers spaced from each other along said track section, with each said transceiver being oriented to transmit microwave energy toward and receive microwave energy reflected from a radially oriented surface of a wheel that transverse said track section, and wherein said step (e) comprises the step of determining a said radical characteristic of wheel at each of said transceivers.

11. The method set forth in claim 10 comprising the additional step of: (f) comparing with each other said radial characteristic as determined at each of said transceivers to detect variations in said radial characteristic potentially indicative of wheel wear.

12. Apparatus for measuring a radial characteristic of train wheels that comprises:

microwave transceiver means for disposition adjacent to a section of train track to transmit microwave energy toward and receive microwave energy reflected from a radially facing surface of a train wheel that rolls over the track, such that said transceiver provides an electrical signal that varies as a function of an interference pattern of signal peaks caused by reflections from the radially facing surface of the wheel, and means responsive to said electrical signal for determining said radial characteristic as a function of separation between said signal peaks in units of distance traveled by the wheel along the track section adjacent to said transceiver means.

13. The apparatus set forth in claim 12 wherein said transceiver means includes means for mounting said transceiver means on a side of the track section so as to direct microwave energy upwardly toward and receive microwave energy reflected downwardly from the flange of a train wheel rolling over the track section.

14. The apparatus set forth in claim 12 wherein said transceiver means includes means at the track section so as to direct microwave energy upwardly toward and receive microwave energy reflected downwardly from the rim of a train wheel rolling over the track section.

15. The apparatus set forth in claim 12 wherein said transceiver means comprises a plurality of microwave transceivers spaced from each other along said track, each of said transceivers developing a corresponding said electrical signal, and wherein said means for determining said radial characteristic determines said characteristic as a combined function of said signals.

16. The apparatus set forth in claim 12 wherein said means for determining said radial characteristic comprises digital processing means including means for periodically sampling said electrical signal.

17. The apparatus set forth in claim 16 wherein said digital processing means includes means for sampling said electrical signal at equal time increments.

18. The apparatus set forth in claim 17 further comprising means for measuring velocity of a wheel traveling on said track section adjacent to said transceiver means.

19. The apparatus set forth in claim 16 further comprising means responsive to passage of a train wheel over said track section adjacent to said transceiver means to enable said periodic sampling of said electrical signal.

20. A method of measuring radius of a test object comprising the steps of:

(a) providing a microwave transceiver oriented to transmit microwave energy toward and receive microwave energy reflected from a radially oriented surface of the test object, (b) causing relative motion of the test object and said transceiver while energizing said transceiver so as to develop at said transceiver an electrical signal that varies as a function of interferences caused by reflections from the surface of the test object, and (c) determining radius of such surface of the test object as a function of said signal.

21. The method set forth in claim 20 wherein said interference pattern developed in said step (b) comprises a sinusoidal interference pattern of signal peaks, and wherein said step (c) comprises the step of determining said radius as a function of separation between said signal peaks.

22. The method set forth in claim 21 wherein said step (c) comprises the step of determining radius of the object surface as a function of separation between said signal peaks in units of distance traveled during said relative motion in said step (b).

23. A method of measuring a circumferential characteristic of train wheels potentially indicative of train wheel wear comprising the steps of:

(a) providing at least one transceiver adjacent to a track section oriented to transmit energy toward and receive energy reflected from a wheel that traverses said track section, (b) causing a train wheel to traverse said track section so as to develop at said transceiver a signal that exhibits an interference pattern caused by reflections from the wheel, and (c) determining radius of the wheel as a function of said interference pattern of said signal.

24. The method set forth in claim 23 wherein said signal interference pattern developed in said step (b) comprises a sinusoidal interference pattern of signal peaks and wherein said step (c) comprises the step of determining wheel radius as a function of separation between said peaks.

25. The method set forth in claim 24 wherein said step (c) comprises the step of determining said wheel radius as a function of separation between said signal peaks in units of distance traveled by the train wheel on said track section past said transceiver.

26. The method set forth in claim 25 wherein said step (b) comprises the step of causing the train wheel to traverse said track section at constant velocity.

27. The method set forth in claim 25 wherein said step (c) comprises the step of determining wheel rim radius.

28. The method set forth in claim 25 wherein said step (c) comprises the step of determining wheel flange radius.

* * * * *